US010607554B2

(12) United States Patent
Kawashima

(10) Patent No.: US 10,607,554 B2
(45) Date of Patent: Mar. 31, 2020

(54) DISPLAY DEVICE FOR DISPLAYING A MARKED IMAGE FIELD

(71) Applicant: Panasonic Liquid Crystal Display Co., Ltd., Himeji-shi, Hyogo (JP)

(72) Inventor: Seiichi Kawashima, Hyogo (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 1 day.

(21) Appl. No.: 15/907,925

(22) Filed: Feb. 28, 2018

(65) Prior Publication Data

US 2019/0266965 A1 Aug. 29, 2019

(51) Int. Cl.
*G09G 3/36* (2006.01)

(52) U.S. Cl.
CPC ..... *G09G 3/3607* (2013.01); *G09G 3/3655* (2013.01); *G09G 2310/027* (2013.01)

(58) Field of Classification Search
CPC ..... G09G 3/36; G09G 5/00; G06F 3/038
See application file for complete search history.

(56) References Cited

U.S. PATENT DOCUMENTS 9,846,340 B1 * 12/2017 Lin ..... G02F 1/13394
2016/0189624 A1 * 6/2016 Jang ..... G09G 3/3258 345/213
2016/0189671 A1 * 6/2016 Kim ..... G09G 3/3291 345/690
2016/0232831 A1 8/2016 Nakanishi et al.
2017/0059944 A1 * 3/2017 Xu ..... G02F 1/1343
2017/0153505 A1 * 6/2017 Du ..... G02F 1/134309
2018/0090084 A1 * 3/2018 Zheng ..... G09G 3/3611
2019/0131352 A1 * 5/2019 Choi ..... H01L 27/124
2019/0200007 A1 * 6/2019 Lee ..... H04N 13/324

* cited by examiner

*Primary Examiner* — Pegeman Karimi

(74) *Attorney, Agent, or Firm* — Hamre, Schumann, Mueller & Larson, P.C.

(57) ABSTRACT

Embodiments of a display device for displaying a marked image on a display device are disclosed. The display device includes a control circuit configured to receive image data and supplementary data, and a display panel. The display panel includes a plurality of main pixels, each of the plurality of main pixels including a main pixel electrode and configured to display the image data, and a plurality of supplementary pixels, each of the plurality of supplementary pixels including a supplementary pixel electrode and configured to display the supplementary data. The plurality of main pixel electrodes are arranged in a series of columns and rows to form a matrix with the plurality of supplementary pixel electrodes being interspersed within the matrix. The plurality of main pixels are larger in size than the plurality of supplementary pixels.

20 Claims, 10 Drawing Sheets

DISPLAY DEVICE FOR DISPLAYING A MARKED IMAGE FIELD

This disclosure relates generally to a display device. More specifically, this disclosure relates to a method and apparatus for displaying a marked image.

BACKGROUND

A display device can be used in the medical profession to display an image. For example, a physiological image may be displayed on monochrome display device. A monochrome display device generally includes a high luminescence and a high contrast ratio for displaying a physiological image. The physiological image can be generally formed on the monochrome display device via white pixels, resulting in a white image and black background.

SUMMARY

This disclosure relates generally to a display device. More specifically, this disclosure relates to a display device for displaying a marked image.

In particular, the embodiments described herein can provide a display device with an image displaying functionality and a mark displaying functionality that is different from the image displaying functionality. For example, the embodiments described herein can display image data as a monochrome image (e.g., black and white) and concurrently display supplementary data as a mark (e.g., a drawing and/or text). The mark can be displayed in a secondary color (e.g., red, blue, green, yellow, etc.). The mark can convey supplemental information relevant to the image. For example, the image can include a mark to highlight or annotate a feature within the image.

In some embodiments, the display device includes a plurality of pixels with one portion of the pixels (e.g., main pixels) displaying image data and other portion of the pixels (e.g., supplementary pixels) displaying supplementary data. In some embodiments, the main pixels can be larger in size than the supplementary pixels. In some embodiments, the number of main pixels can be the same as the number of supplementary pixels. In other embodiments, the number of main pixels can be greater than the number of supplementary pixels. Also, in some embodiments, the main pixels can be driven at a higher refresh rate than the supplementary pixels. Due to the decreased amount of voltage provided to power the pixel electrodes, the different voltage and timing signal data can conserve electrical power. Accordingly, the display device can conserve electrical power and money.

In one embodiment, a display device is provided. The display device includes a control circuit configured to receive image data and supplementary data, and a display panel. The display panel includes a source driver driving a plurality of source lines extending in a first direction, a gate driver driving a plurality of gate lines extending in a second direction different from the first direction, and a plurality of thin film transistors (TFTs) each of which is connected to a corresponding gate line of the plurality of gate lines and connected to a corresponding source line of the plurality of source lines. The display panel also includes a plurality of main pixels, each of the plurality of main pixels including a main pixel electrode that is electrically connected to a corresponding TFT of the plurality of TFTs. The plurality of main pixel electrodes are configured to display the image data. The display panel also include a plurality of supplementary pixels, each of the plurality of supplementary pixels including a supplementary pixel electrode that is electrically connected to a corresponding TFT of the plurality of TFTs. The plurality of supplementary pixel electrodes are configured to display the supplementary data. The plurality of main pixel electrodes are arranged in a series of columns and rows to form a matrix, the plurality of supplementary pixel electrodes are interspersed within the matrix. The plurality of main pixels are larger in size than the plurality of supplementary pixels.

In some embodiments, the control circuit provides the supplementary data, the image data, and timing signal data to the source driver, and the control circuit provides the timing signal data to the gate driver.

In some embodiments, the plurality of main pixel electrodes are configured to display the image data as a monochrome image (e.g., in black and white). Each supplementary pixel electrode of the plurality of supplementary pixel electrodes is associated with a corresponding color filter to display the supplementary data in a secondary color.

In some embodiments, the color filter associated with each of the plurality of supplementary pixel electrodes is a first color type color filter and the plurality of supplementary pixel electrodes are configured to display the supplementary data in a single secondary color based on the first color type color filter.

In some embodiments, the color filter associated with each of a first set of the plurality of supplementary pixel electrodes is a first color type color filter to display a first color and the color filter associated with each of a second set of the plurality of supplementary pixel electrodes is a second color type color filter to display a second color that is different from the first color. The plurality of supplementary pixel electrodes and the associated color filters are configured to display the supplementary data in more than one secondary color such that the first set of the plurality of supplementary pixel electrodes display the supplementary data in the first color based on the first color type color filter and the second set of the plurality of supplementary pixel electrodes display the supplementary data in the second color.

In some embodiments, the first set of the plurality of supplementary pixel electrodes are arranged in a first column within the matrix, and the second set of the plurality of supplementary pixel electrodes are arranged in a second column within the matrix.

In some embodiments, the first set of the plurality of supplementary pixel electrodes are arranged in a first row within the matrix, and the second set of the plurality of supplementary pixel electrodes are arranged in a second row within the matrix.

In some embodiments, the color filter associated with each of the plurality of supplementary pixel electrodes has a size smaller than the supplementary pixel electrode that the color filter is associated with.

In some embodiments, the color filter associated with each of the plurality of supplementary pixel electrodes is half the size of the supplementary pixel electrode that the color filter is associated with.

In some embodiments, each main pixel of the plurality of main pixels is adjacent in a row direction to a corresponding supplementary pixel of the plurality of supplementary pixel to form a ratio of main pixels to supplementary pixel that is one to one within the matrix.

In some embodiments, a portion of the plurality of main pixels are adjacent to a corresponding supplementary pixel of the plurality of supplementary pixels in a single direction and a different portion of the main pixels of the plurality of main pixels are adjacent to other main pixels of the plurality of main pixels in the single direction such that the plurality of main pixels outnumber the plurality of supplementary pixels to form a ratio of main pixels to supplementary pixels that is greater than one to one within the matrix. In some embodiments, the single direction can be a row direction. In other embodiments, the single direction can be a column direction.

In some embodiments, the gate driver includes a first gate driver and a second gate driver, the plurality of gate lines include main pixel gate lines and supplementary gate lines, and the first gate driver drives the main pixel gate lines and the second gate driver drives the supplementary gate lines. The plurality of TFTs include main TFTs and supplementary TFTs such that each of the main TFTs is electrically connected to a corresponding main pixel electrode of the plurality of main pixel electrodes and each of the supplementary TFTs is electrically connected to a corresponding supplementary pixel electrode of the plurality of supplementary pixel electrodes. The plurality of source lines includes main pixel source lines and supplementary pixel source lines. The main pixel source lines supply image voltages corresponding to the image data, and the supplementary pixel lines supply supplementary voltages corresponding to the supplementary data. The main pixel gate lines supply main gate voltages from the first gate driver to the main TFTs and the supplementary pixel gate lines supply the supplementary gate voltages from the second gate driver to the supplementary TFTs. The first gate driver outputs the main gate voltages in line with a first refresh rate of the plurality of main pixel electrodes, and the second gate driver outputs the supplementary gate voltages in line with a second refresh rate of the plurality of supplementary pixel electrodes.

In some embodiments, the gate driver includes a first gate driver and a second gate driver, the plurality of gate lines include main pixel gate lines and supplementary gate lines, and the first gate driver drives the main pixel gate lines and the second gate driver drives the supplementary gate lines. The source driver includes a first source driver and a second source driver, the plurality of source lines includes main pixel source lines and supplementary pixel source lines, and the first source driver drives the main pixel source lines and the second source driver drives the supplementary pixel source lines. The plurality of TFTs include main TFTs and supplementary TFTs such that each of the main TFTs is electrically connected to a corresponding main pixel electrode of the plurality of main pixel electrodes and each of the supplementary TFTs is electrically connected to a corresponding supplementary pixel electrode of the plurality of supplementary pixel electrodes. The main pixel source lines supply image data voltages corresponding to the image data from the first source driver to the main TFTs, and the supplementary pixel lines supply supplementary data voltages corresponding to the supplementary data from the second source driver to the supplementary TFTs. The main pixel gate lines supply the main gate voltages from the first gate driver to the main TFTs, and the supplementary pixel gate lines supply the supplementary gate voltages from the second gate driver to the supplementary TFTs. The first gate driver outputs the main gate voltages in line with a first refresh rate of the plurality of main pixel electrodes, and the second gate driver outputs the supplementary gate voltages in line with a second refresh rate of the plurality of supplementary pixel electrodes.

In some embodiments, the plurality of main pixel electrodes is driven at a first refresh rate, the plurality of supplementary pixel electrodes is capable of being driven at a second refresh rate that is less than the first refresh rate. In some embodiments, the first refresh rate and the second refresh rate are the same. In other embodiments, the second refresh rate is less than the first refresh rate.

In some embodiments, the plurality of main pixel electrodes is driven at a 60 hertz frequency, and the plurality of supplementary pixel electrodes is driven at one of a 15 hertz frequency, a 20 hertz frequency, and a 30 hertz frequency.

In some embodiments, the display device also includes a touch detection circuit configured to allow a user to input the supplementary data, wherein the touch detection circuit sends the supplementary data to the control circuit.

In some embodiments, each main pixel of the plurality of main pixels is defined by a main pixel area between two adjacent gate lines of the plurality of gate lines and two adjacent source lines of the plurality of source lines that surround the corresponding main pixel electrode of the respective main pixel. Each supplementary pixel of the plurality of supplementary pixels is defined by a supplementary pixel area between two adjacent gate lines of the plurality of gate lines and two adjacent source lines of the plurality of source lines that surround the corresponding supplementary pixel electrode of the respective supplementary pixel. The main pixel area is larger than the supplementary pixel area.

In some embodiments, each of the plurality of main pixel electrodes is larger than each of the plurality of supplementary pixel electrodes.

In some embodiments, each of the plurality of main pixel electrodes is in a range of approximately 2-5 times larger than each of the plurality of supplementary pixel electrodes.

BRIEF DESCRIPTION OF THE DRAWINGS

Reference is now made to the drawings in which like reference numbers represent corresponding parts throughout.

DETAILED DESCRIPTION

Figure 1:
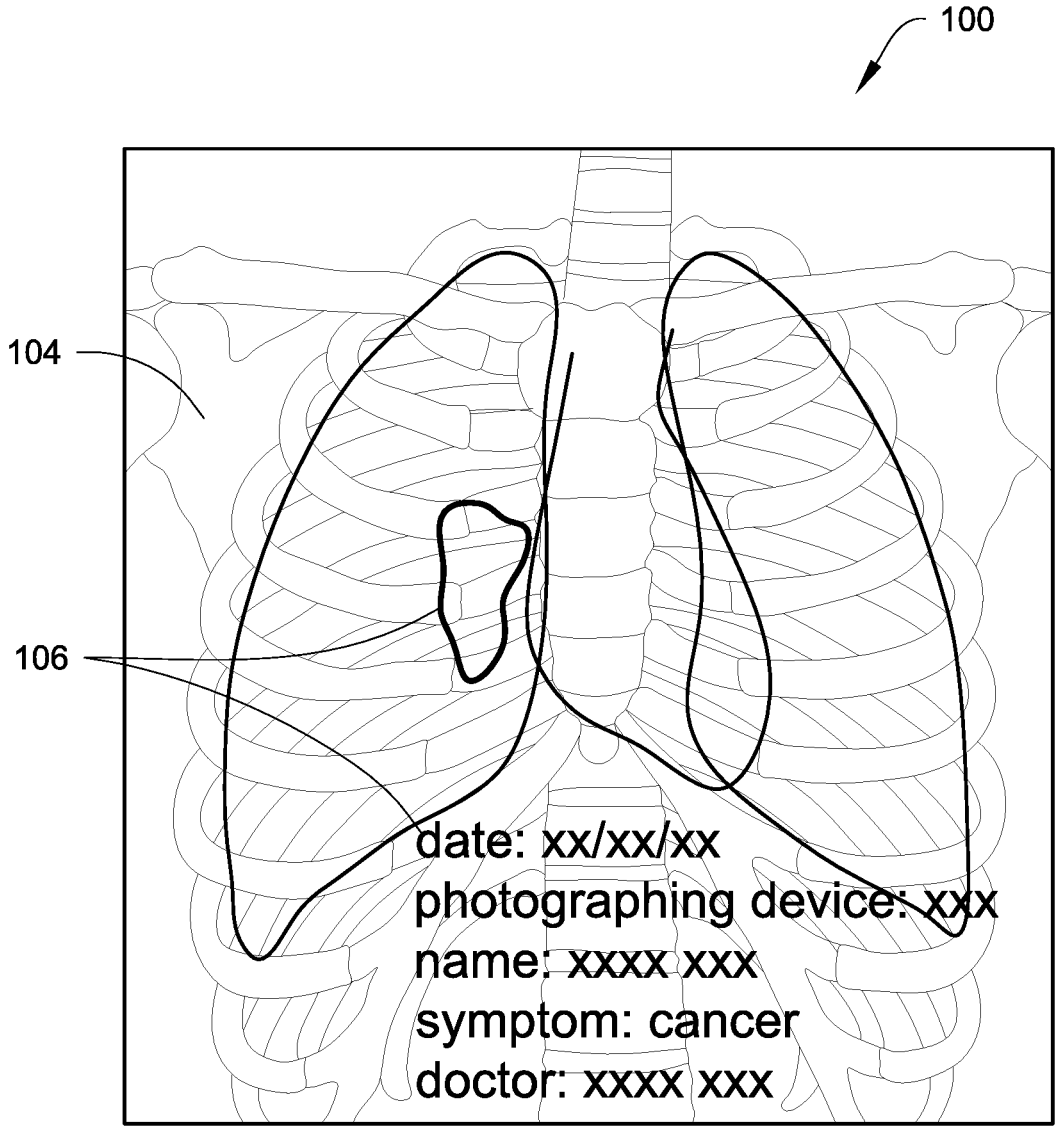
FIG. 1 illustrates an image with a mark displayed on a display device, according to one embodiment.

This disclosure relates generally to a display device. More specifically, this disclosure relates to a method and apparatus for displaying a marked image on a display device.

In particular, the embodiments described herein can provide a display device with an image displaying functionality and a mark displaying functionality that is different from the image displaying functionality. For example, the embodiments described herein can display image data as a monochrome image (e.g., black and white) and concurrently display supplementary data as a mark (e.g., a drawing and/or text). The mark can be displayed in a secondary color (e.g., red, blue, green, yellow, etc.). The mark can convey supplemental information relevant to the image. For example, the image can include a mark to highlight or annotate a feature within the image.

In some embodiments, the display device includes a plurality of pixels with one portion of the pixels (e.g., main pixels) displaying image data and an other portion of the pixels (e.g., supplementary pixels) displaying supplementary data. In some embodiments, the main pixels can be larger in size than the supplementary pixels. In some embodiments, the number of main pixels can be the same as the number of supplementary pixels. In other embodiments, the number of main pixels can be greater than the number of supplementary pixels. Also, in some embodiments, the main pixels can be driven at a higher refresh rate than the supplementary pixels. Due to the decreased amount of voltage provided to power the pixel electrodes, the different voltage and timing signal data can conserve electrical power. Accordingly, the display device can conserve electrical power and money. Features and additional information will be discussed in more detail below.

A display device has pixels to display images across a screen for visual viewing. A pixel is a basic unit of programmable color on a display device. In some embodiments, each pixel is defined by an area between two adjacent gate lines and two adjacent source lines that surround a corresponding pixel electrode of the pixel. The two adjacent gate lines and two adjacent source lines can form a square or rectangular area. For example, the two adjacent gate lines may be parallel in a horizontal direction while the two adjacent source lines are parallel in a vertical direction. The two adjacent gate lines and two adjacent source lines may overlap to form the square or rectangular area to define the area in which a single pixel electrode resides. A common electrode shared by the plurality of pixels are provided so as to oppose a plurality of pixel electrodes.

A data voltage is supplied to each source line from a corresponding source driver. A gate voltage (gate-on voltage or gate-off voltage) is supplied to each gate line from a corresponding gate driver. When the display device is composed of a liquid crystal display device, a common voltage is supplied from a common driver to the common electrode. When a gate-on voltage is supplied to the gate line, thin film transistors (TFTs) connected to the gate line is turned on to supply the data voltages to the pixel electrodes through the source lines connected to TFTs. An electric field is generated by a difference between the data voltage supplied to the pixel electrode and the common voltage supplied to the common electrode. A liquid crystal is driven by the electric field to control transmittance of the light transmitted from a backlight, thereby displaying the image.

FIG. 1 illustrates an image 104 with marks 106 displayed on a display device 100, according to one embodiment. In this embodiment, the display device 100 depicts the image 104 in black and white and the marks 106 in color. The marks 106 are added to identify a specific area of the image 104 and to provide information regarding the image 104. As shown in FIG. 1, the marks 106 include a drawing identifying a specific portion of the image 104 and text providing information related to the image 104.

It will be appreciated that while FIG. 1 illustrates the marks 106 including both the drawing and the text, in other embodiments the number of marks 106 displayed on the display device 100 can vary. For example, in some embodiments, the display device 100 may only include one or more marks that are drawings or may include one or more marks that are text. It will also be appreciated that in some embodiments, the display device 100 may not display a mark when displaying an image even though the display device 100 is capable of displaying one or more marks along with the image.

A user may incorporate the drawing onto the display device 100 to identify a specific area of the image 104 and incorporate text to provide information regarding the image 104. The marks 106 may be displayed by the display device 100 using one or more colors, such as red, yellow, green, blue, etc.

Figure 2A:
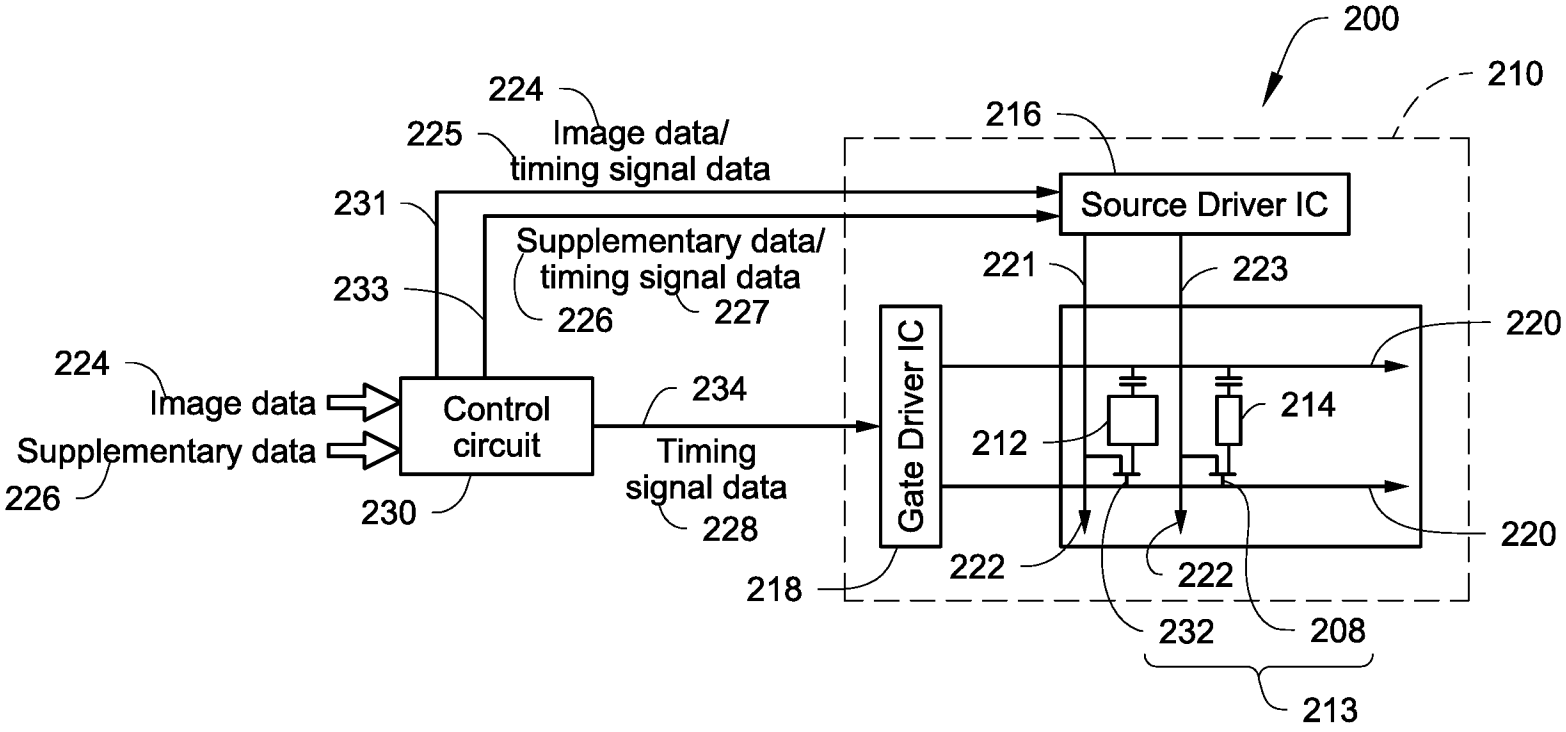
FIG. 2A illustrates a schematic diagram of a display device, according to a first embodiment.

FIG. 2A illustrates a schematic diagram of a display device 200 (e.g., the display device 100 shown in FIG. 1), according to a first embodiment. As illustrated in FIG. 2A, the display device 200 includes a control circuit 230 and a display panel 210.

The display panel 210 includes a source driver 216, a gate driver 218, a plurality of thin film transistors (TFTs) 213, a plurality of main pixel electrodes 212, and a plurality of supplementary pixel electrodes 214. The source driver 216 drives a plurality of source lines 222 extending in a first direction. The gate driver 218 drives a plurality of gate lines 220 extending in a second direction different from the first direction. As shown in FIG. 2A, the plurality of gate lines 220 extend in a horizontal direction while the plurality of source lines 222 extend in a vertical direction. However, in other embodiments, the plurality of gate lines 220 may extend in a vertical direction while the plurality of source lines 222 may extend in a horizontal direction. Each of the plurality of thin film transistors (TFTs) 213 is connected to a corresponding gate line of the plurality of gate lines 220 and is connected to a corresponding source line of the plurality of source lines 222.

The plurality of TFTs 213 includes a plurality of main TFTs 232 and a plurality of supplementary TFTs 208. Each of the plurality of main pixel electrodes 212 is electrically connected to a corresponding main TFT 232. Each of the plurality of supplementary pixel electrodes 214 is electrically connected to a corresponding supplementary TFT 208. As used herein, the main TFT 232 and supplementary TFT 208 are generally referred to as the plurality of TFTs 213. The plurality of source lines 222 include a plurality of main pixel source lines 221 and a plurality of supplementary pixel source lines 223. The plurality of main pixel source lines 221 supply image data voltages corresponding to image data 224 from the source driver 216 to the plurality of main TFTs 232. The plurality of supplementary pixel lines 223 supply supplementary data voltages corresponding to supplementary data 226 from the source driver 216 to the supplementary TFTs 208.

The plurality of main pixel electrodes 212 (main pixels) is configured to display the image data 224, and the plurality of supplementary pixel electrodes 214 (supplementary pixels) is configured to display supplementary data 226. For example, the plurality of main pixels may display an image (e.g., the image 104 shown in FIG. 1) on the display panel 210 while the plurality of supplementary pixels may display a mark (e.g., the marks 106 shown in FIG. 1) on the display panel 210. The supplementary data 226 may be input from an input device such as, for example, a mouse, a keyboard, or the like. It will be appreciated that each of the main pixel electrodes 212 and each of the plurality of supplementary pixel electrodes 214 functions to generate an electrical field to liquid molecules.

In some embodiments, the plurality of main pixel electrodes 212 is configured to display the image data 224 as a monochrome image (e.g., in black and white). In some embodiments, each supplementary pixel electrode of the plurality of supplementary pixel electrodes 214 can be associated with a corresponding color filter to display the supplementary data 226 in one or more secondary colors. For example, the plurality of main pixels can display the image data 224 as a black and white image while the plurality of supplementary pixels can display the supplementary data 226 as one or more marks in one or more different colors (e.g., red, blue, green, yellow, etc.).

The control circuit 230 is configured to control what is displayed by the display device 200. In particular, the control circuit 230 is configured to receive image data 224 that is used to display an image (e.g., the image 104 shown in FIG. 1) on the display panel 210. The control circuit 230 is also configured to receive supplementary data 226 that is used to display one or more marks (e.g., the marks 106 shown in FIG. 1) on the display panel 210. The control circuit 230 provides timing signal data 228 to the gate driver 218 via a connection 234. The control circuit 230 provides image data 224 and main pixel timing signal data 225 to the source driver 216 via a main pixel connection 231. The control circuit 230 also provides supplementary data 226 and supplementary pixel timing signal data 227 to the source driver via a supplementary pixel connection 233.

The timing signal data 225, 227, 228 includes information to the gate driver 218 and the source driver 216 regarding when a voltage is supplied to each of the plurality of TFTs 213. Accordingly, the timing signal data 225, 228 along with the image data 224 allow the display panel 210 to drive one or more of the plurality of main pixel electrodes 212 to display an image via the display device 200. Concurrently, the timing signal data 227, 228 along with the supplementary data 226 allow the display panel 210 to drive one or more of the plurality of supplementary pixel electrodes 214 to display one or more marks via the display device 200. Thus, the plurality of main pixels and plurality of supplementary pixels can display an image with one or more marks on the display panel 210.

Figure 2B:
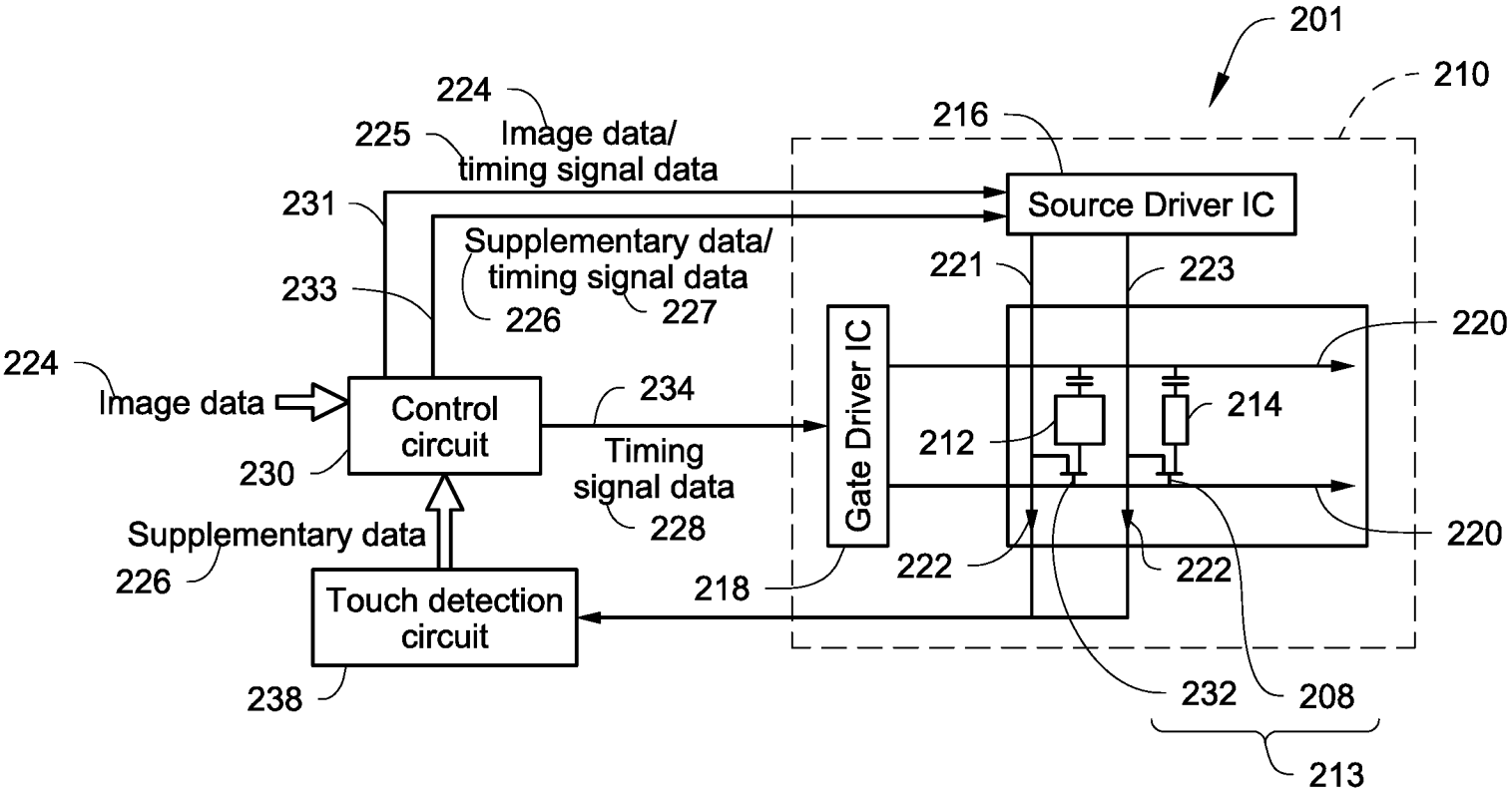
FIG. 2B illustrates a schematic diagram of a display device, according to a second embodiment.

FIG. 2B illustrates a schematic diagram of a display device 201, according to a second embodiment. For simplicity of this specification, features which are the same and were previously described with respect to FIG. 2A will not be described in additional detail.

In this embodiment, the display device 201 includes a touch detection circuit 238 connected to the control circuit 230. The touch detection circuit 238 is configured to provide the supplementary data 226 to the control circuit 230. The touch detection circuit 238 can be, for example, a touch panel, touch screen, or the like that allows a user to input the supplementary data 226. The touch detection circuit 238 sends the supplementary data 226 to the control circuit 230. The data (e.g., image data 224, supplementary data 226) provided from the control circuit 230 is discussed further below.

Figure 3A:
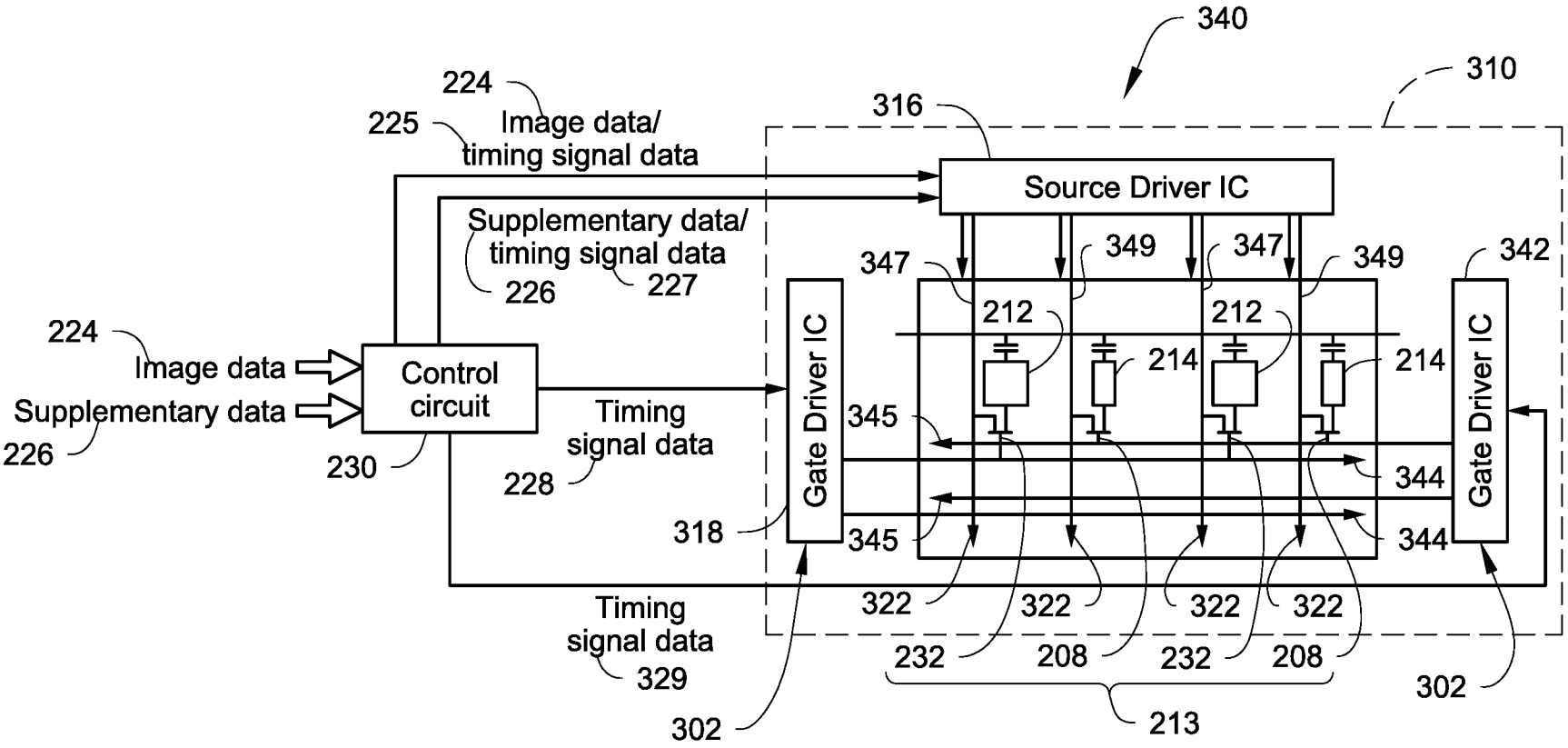
FIG. 3A illustrates a schematic diagram of a display device with multiple gate drivers, according to one embodiment.

FIG. 3A illustrates a schematic diagram of a display device 340 with multiple gate drivers 318, 342, according to one embodiment. For simplicity of this specification, features which are the same and were previously described with respect to FIG. 2A will not be described in additional detail.

Figure 3B:
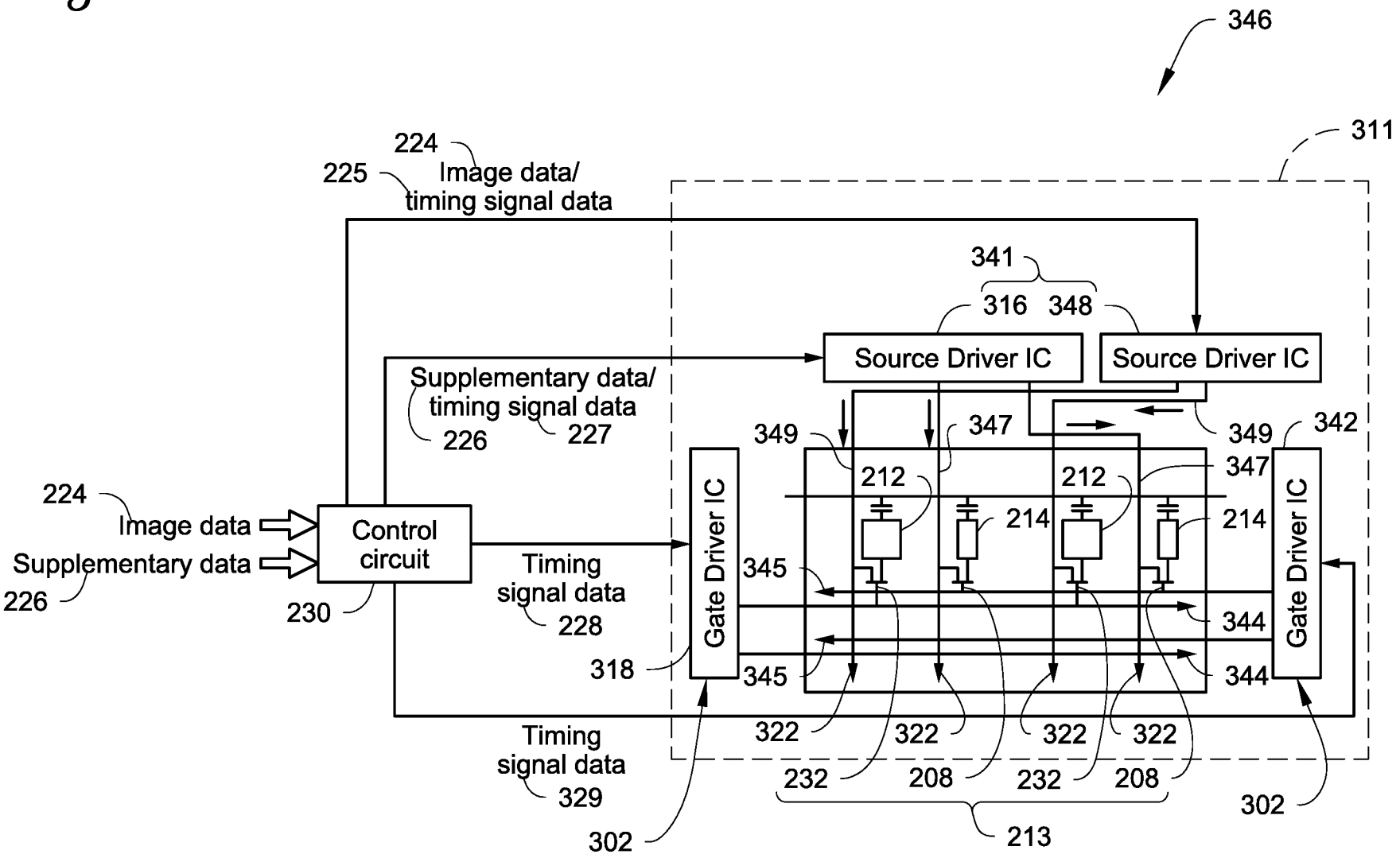
FIG. 3B illustrates a schematic diagram of a display device with multiple gate drivers and multiple source drivers, according to one embodiment.

In this embodiment, the display device 340 includes a device panel 310 that includes a source driver 316, a first gate driver 318, a second gate driver 342 in addition to the plurality of TFTs 213, the plurality of main pixel electrodes 212, and the plurality of supplementary pixel electrodes 214. The gate driver 302 includes the first gate driver 318 and the second gate driver 342. In this embodiment, the first gate driver 318 and the second gate driver 342 are separate and distinct. As shown in FIG. 3A, the first gate driver 318 drives a plurality of first gate lines 344 and the second gate driver 342 drives a plurality of second gate lines 345 extending in the second direction. The second direction can be a horizontal direction, as shown in FIG. 3B. However, in other embodiments, the second direction may be vertical.

The source driver 316 drives a plurality of source lines 322, which includes main pixel source lines 347 and supplementary pixel source lines 349. The main pixel source lines 347 supply image voltages corresponding to the image data 224, and the supplementary pixel source lines 349 supply supplementary voltages corresponding to the supplementary data 226. The image voltages corresponding to the image data 224 and the supplementary voltages corresponding to the supplementary data 226 can have different values. For example, the image voltages can have higher voltage values than the supplementary voltages. In other words, the plurality of main pixel electrodes 212 that are used to make up the image data 224 can utilize a higher voltage value than the plurality of supplementary pixel electrodes 214 that are used to make up the supplementary data 226. One advantage to having different voltage values corresponding with different pixel electrodes is conserving power and/or saving money associated with supplying lower/decreased voltage.

The plurality of first gate lines 344 are main pixel gate lines that supply main gate voltages from the first gate driver 318 to the main TFTs 232. The plurality of second gate lines 345 are supplementary pixel gate lines that supply supplementary gate voltages from the second gate driver 342 to the supplementary TFTs 208. In other words, the first gate driver 318 supplies the main TFTs 232 of the plurality of main pixel electrodes 212 with main gate voltages, while the second gate driver 342 supplies the supplementary TFTs 208 of the plurality of supplementary pixel electrodes 214 with supplementary gate voltages.

In some embodiments, the plurality of main pixel electrodes 212 can be driven at a higher refresh rate (e.g., frequency) than the plurality of supplementary pixel electrodes 214. For example, in one embodiment, the source driver 316 (via the main pixel source lines 347) and the first gate driver 318 (via the plurality of first gate lines 344) can drive the main pixel electrodes 212 at a 60 hertz frequency, and the source driver 316 (via the plurality of supplementary pixel source lines 349) and the second gate driver 342 (via the plurality of supplementary pixel gate lines 345) can drive the plurality of supplementary pixel electrodes 214 at one of a 15 hertz frequency, a 20 hertz frequency, and a 30 hertz frequency. That is, the first gate driver 318 outputs the main gate voltages in line with a first refresh rate of the plurality of main pixel electrodes 212, and the second gate driver 342 outputs the supplementary gate voltages in line with a second refresh rate of the plurality of supplementary pixel electrodes 214. For example, when the plurality of supplementary pixel electrodes 214 are driven at a 30 hertz frequency and the source driver 316 is configured to a 60 hertz type source driver, the source driver 316 outputs the supplementary voltage and a minimum grayscale voltage (e.g., zero voltage) alternatively so as to artificially drive the plurality of supplementary pixel electrode 214 at the 30 hertz frequency.

The timing signal data 225, 227, 228, 329 includes information to the gate driver 302 and the source driver 216 regarding when a voltage is supplied to each of the plurality of TFTs 213. In this embodiment, the timing signal data 227 along with the supplementary data 226 is provided to the source driver 316, while the timing signal data 329 is provided to the second gate driver 342. Further depicted in this embodiment is the timing signal data 225 along with the image data 224 is provided to the source driver 316. The timing signal data 228 is provided to the first gate driver 318. It will be appreciated that the timing signals 227 and 329 may be different. Additionally, it will be appreciated that timing signals 225 and 228 may be different.

Accordingly, the timing signal data 225, 228, along with the image data 224 allow the display panel 310 to drive one or more of the plurality of main pixel electrodes 212 to display an image via the display device 340. Concurrently, the timing signal data 227, 329 along with the supplementary data 226 allow the display panel 340 to drive one or more of the plurality of supplementary pixel electrodes 214 to display one or more marks via the display device 340. Thus, the plurality of main pixels and plurality of supplementary pixels can display an image with one or more marks on the display panel 310.

FIG. 3B illustrates a schematic diagram of a display device 346 with multiple gate drivers 318, 342 and multiple source drivers 316, 348, according to another embodiment. FIG. 3B includes the same or similar features discussed above with respect to FIG. 3A. Features previously discussed will not be repeated for purposes of brevity.

In this embodiment, the source driver 341 includes a first source driver 316 and a second source driver 348. The first source driver 316 and the second source driver 348 are separate and distinct. The display panel 311 includes a plurality of source lines 322 that include a plurality of main pixel source lines 347 connecting the first source driver 316 to the plurality of main pixel TFTs 232 and a plurality of supplementary pixel source lines 349 connecting the second source driver 348 to the plurality of supplementary pixel TFTs 208. The first source driver 316 is configured to drive the plurality of main pixel electrodes 212 and the second source driver 348 is configured to drive the plurality of supplementary pixel electrodes 214.

In some embodiments, the plurality of main pixel electrodes 212 can be driven at a higher refresh rate (e.g., frequency) than the plurality of supplementary pixel electrodes 214. For example, in one embodiment, the first source driver 316 (via the main pixel source lines 347) and the first gate driver 318 (via the plurality of first gate lines 344) can drive the main pixel electrodes 212 at a 60 hertz frequency, and the second source driver 348 (via the plurality of supplementary pixel source lines 349) and the second gate driver 342 (via the plurality of supplementary pixel gate lines 345) drive the plurality of supplementary pixel electrodes 214 at one of a 15 hertz frequency, a 20 hertz frequency, and a 30 hertz frequency. The plurality of main pixel electrodes 212 can be driven at a first refresh rate, the plurality of supplementary pixel electrodes 214 can be driven at a second refresh rate that is less than the first refresh rate. The difference in refresh rates between the main pixel electrodes 212 and the supplementary pixel electrodes 214 can increase efficiency while saving money and resources. For example, different refresh rates can allot different voltages frequencies. The frequency for the supplementary pixel electrodes 214 is less than the frequency allotted to the main pixel electrodes 212. As such, less voltage may be provided to the plurality of pixel electrodes as a whole, reducing the amount of total voltage, thereby reducing costs and increasing efficiency.

The timing signal data 225, 227, 228, 329 includes information to the gate driver 302 and the source driver 216 regarding when a voltage is supplied to each of the plurality of TFTs 213. In this embodiment, the timing signal data 227 along with the supplementary data 226 is provided to the first source driver 316, while the timing signal data 329 is provided to the second gate driver 342. Further depicted in this embodiment is the timing signal data 225 along with the image data 224 is provided to the second source driver 348. The timing signal data 228 is provided to the first gate driver 318. It will be appreciated that the timing signals 227 and 329 may be different. Additionally, it will be appreciated that timing signal data 225 and 228 may be different.

Accordingly, the timing signal data 225, 228, along with the image data 224 allow the display panel 310 to drive one or more of the plurality of main pixel electrodes 212 to display an image via the display device 346. Concurrently, the timing signal data 227, 329 along with the supplementary data 226 allow the display panel 346 to drive one or more of the plurality of supplementary pixel electrodes 214 to display one or more marks via the display device 346. Thus, the plurality of main pixels and plurality of supplementary pixels can display an image with one or more marks on the display panel 311.

Figure 4:
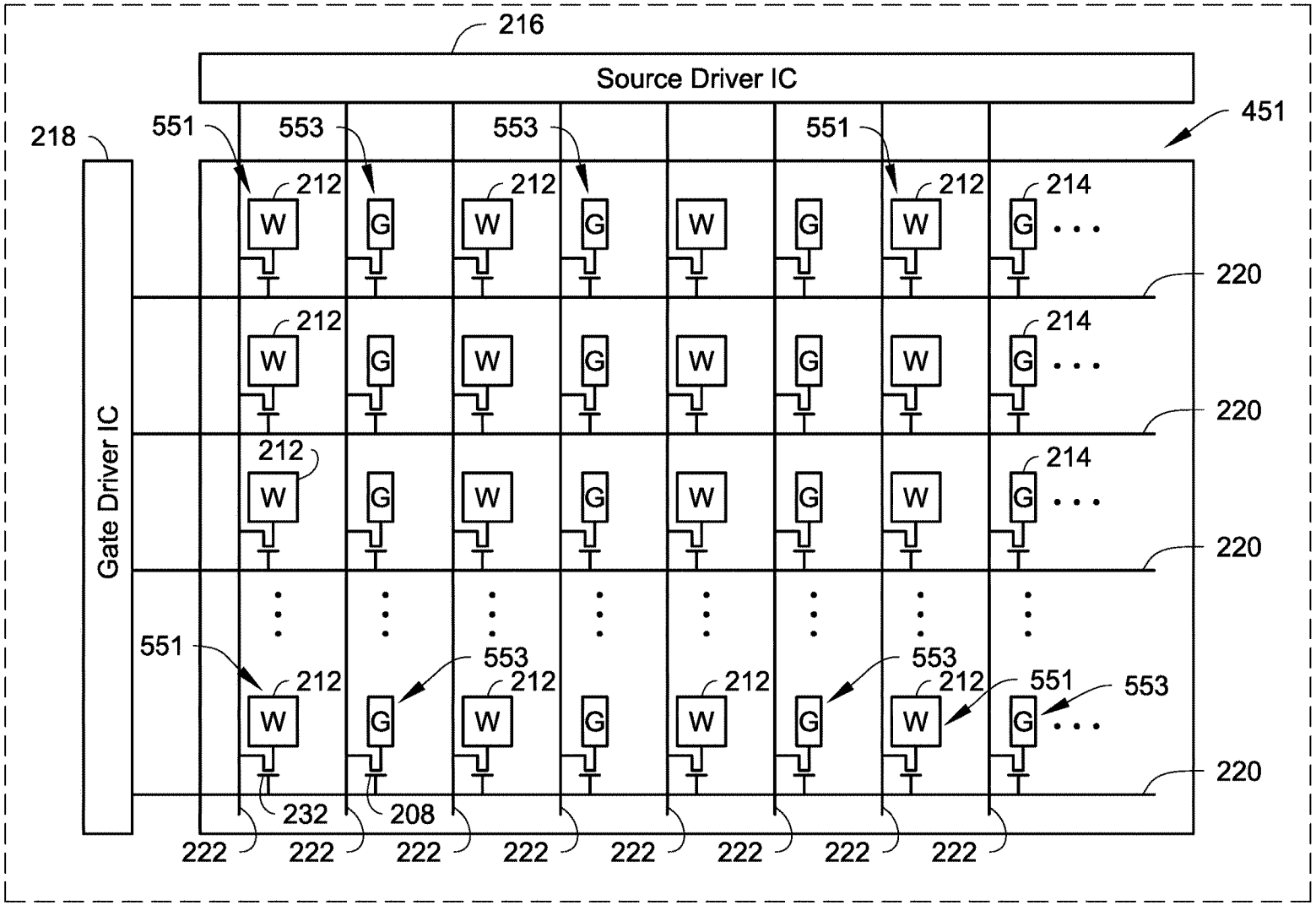
FIG. 4 illustrates a plan view of a configuration of a display panel, according to one embodiment.

FIG. 4 illustrates a plan view of a configuration of a display panel 450, according to one embodiment. The display panel 450 can be used, for example, in the display device 200, 201 shown in FIGS. 2A and 2B. As illustrated in FIG. 4, the display panel 450 depicts a plurality of main pixel electrodes 212 arranged in a series of columns and rows to form a matrix 451. The display panel 450 also includes a plurality of supplementary pixel electrodes 214 that are interspersed within the matrix 451. In this embodiment, the plurality of main pixel electrodes 212 is larger in size than the plurality of supplementary pixel electrodes 214. In some embodiments, each of the plurality of main pixel electrodes 212 can be in a range of approximately 2-5 times larger than each of the plurality of supplementary pixel electrodes 214.

The plurality of main pixels is configured to display image data (e.g., the image data 224 discussed in FIGS. 2A and 2B) as a monochrome image (e.g., in black and white). For example, the plurality of main pixels may not include a color filter, thereby displaying an image in white light.

Each supplementary pixel electrode of the plurality of supplementary pixel electrodes 214 can be associated with a corresponding color filter (not illustrated) to display supplementary data (e.g., the supplementary data 226 discussed in FIGS. 2A and 2B) in a secondary color. For example, each of the plurality of supplementary pixels can include a color filter, such as red, green, blue, yellow, or the like.

Each pixel electrode within the display panel 450 can either be a main pixel electrode 212 or a supplementary pixel electrode 214. The main pixel electrodes 212 and the supplementary pixel electrodes 214 are different types of pixel electrodes. The main pixel electrodes 212 are larger in size than the supplementary pixel electrodes 214. The main pixel electrodes 212 are configured to display white in color, while the supplementary pixel electrodes 214 include a color filter. The color filter can be a different color, as discussed further herein.

In some embodiments, each main pixel electrode of the plurality of main pixel electrodes 212 is defined by an area between two parallel gate lines and two parallel source lines that overlap to form a rectangular area, and the main pixel electrode can have a rectangular area larger than another rectangular area of a supplementary pixel electrode of the of plurality supplementary pixel electrodes 214. Additionally, the supplementary pixel electrode of the of plurality supplementary pixel electrodes 214 can have a rectangular area less than another rectangular area of the main pixel electrode of the plurality of main pixel electrodes 212.

In some embodiments, the display panel 450 can include two gate drivers with one source driver, as discussed above with respect to FIG. 3A. Additionally or alternatively, in some embodiments, the display panel 450 can include two gate drivers and two source drivers, as discussed above with respect to FIG. 3B.

As illustrated in FIG. 4, a main pixel is defined by a main pixel area between two adjacent gate lines 220 and two adjacent source lines 222 that surround a corresponding main pixel electrode of the plurality of main pixel electrodes 212. A supplementary pixel is defined by a supplementary pixel area between two adjacent gate lines 220 and two adjacent source lines 222 that surround a corresponding supplementary pixel electrode of the plurality of supplementary pixel electrodes 214. As a whole, the plurality of main pixels is larger in size than the plurality of supplementary pixels.

Figure 5:
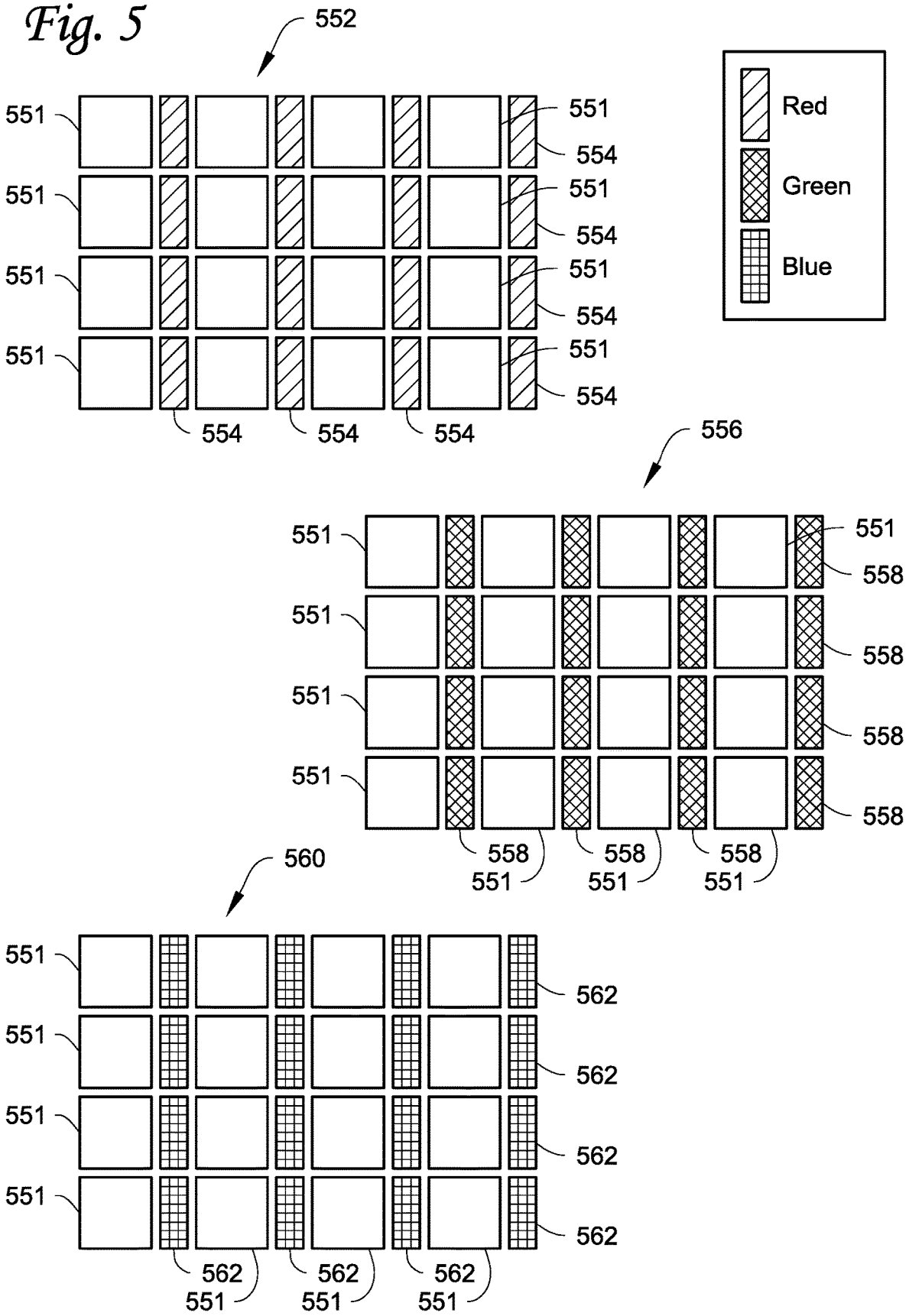
FIG. 5 illustrates a plan view of three different pixel configurations of a display device, according to three different embodiments.

FIG. 5 illustrates a plan view of three different pixel configurations 552, 556, 560 of a display device (e.g., the display device 200 shown in FIG. 2A), according to three different embodiments. Each of the pixel configurations 552, 556, 560 includes a plurality of main pixels 551 arranged in a plurality of columns and rows to form a matrix. Each of the pixel configurations 552, 556, 560 also include a respective plurality of supplementary pixels 554, 558, 562. As shown in each of the pixel configurations 552, 556, 560, each main pixel of the plurality of main pixels 551 is adjacent in a row direction to a corresponding supplementary pixel of the plurality of supplementary pixels 554, 558, 562 to form a ratio of main pixels 551 to supplementary pixels 554, 558, 562 that is one to one within the matrix. That is, the plurality of main pixels 551 and the plurality of supplementary pixels 554, 558, 562 form a ratio of 1:1.

Each of the plurality of supplementary pixels 554, 558, 562 is configured to display supplementary data in a single secondary color based on the type of color filter used. That is, each of the plurality of supplementary pixels 554, 558, 562 includes a color filter that allows the supplementary pixels 554, 558, 562 to be illuminated in a different color. For example, each of the plurality of supplementary pixels 554 in the pixel configuration 552 includes a red color filter. The red color filter allows the plurality of supplementary pixels 554 to illuminate a red color light. Each of the plurality of supplementary pixels 558 in the pixel configuration 556 includes a green color filter. The green color filter allows the plurality of supplementary pixels 558 to illuminate a green color light. Each of the plurality of supplementary pixels 562 in the pixel configuration 560 includes a blue color filter. The blue color filter allows the plurality of supplementary pixels 562 to illuminate a blue color light.

Figure 6A:
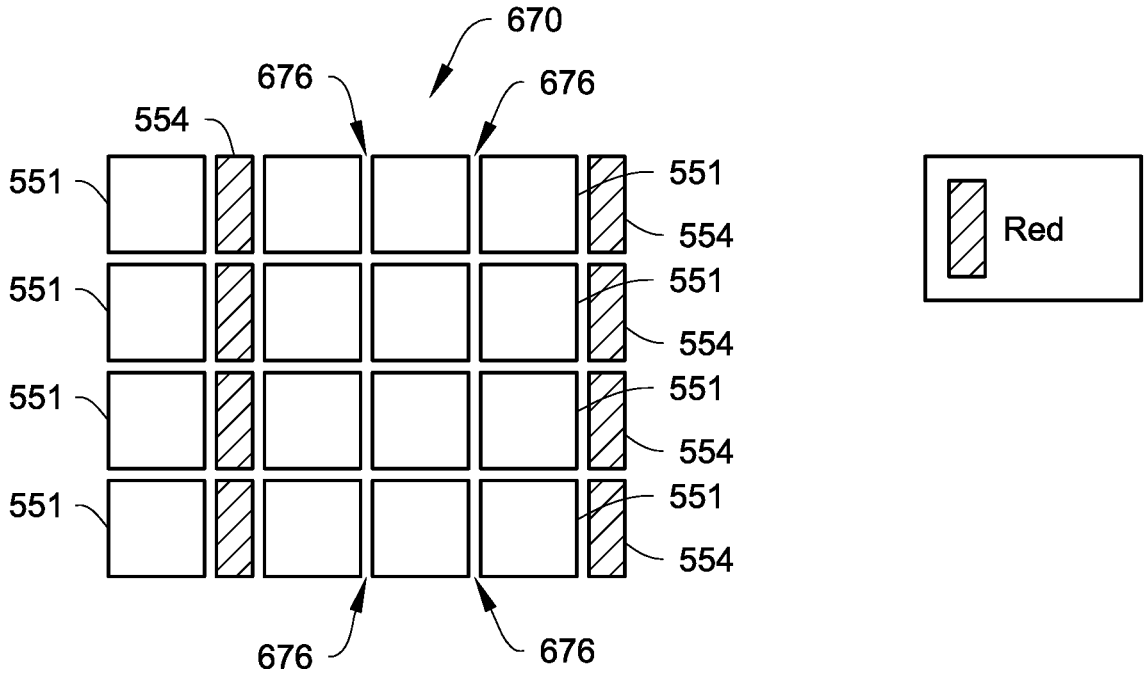
FIG. 6A illustrates a plan view of a pixel configuration of a display device, according to one embodiment.
Figure 6B:
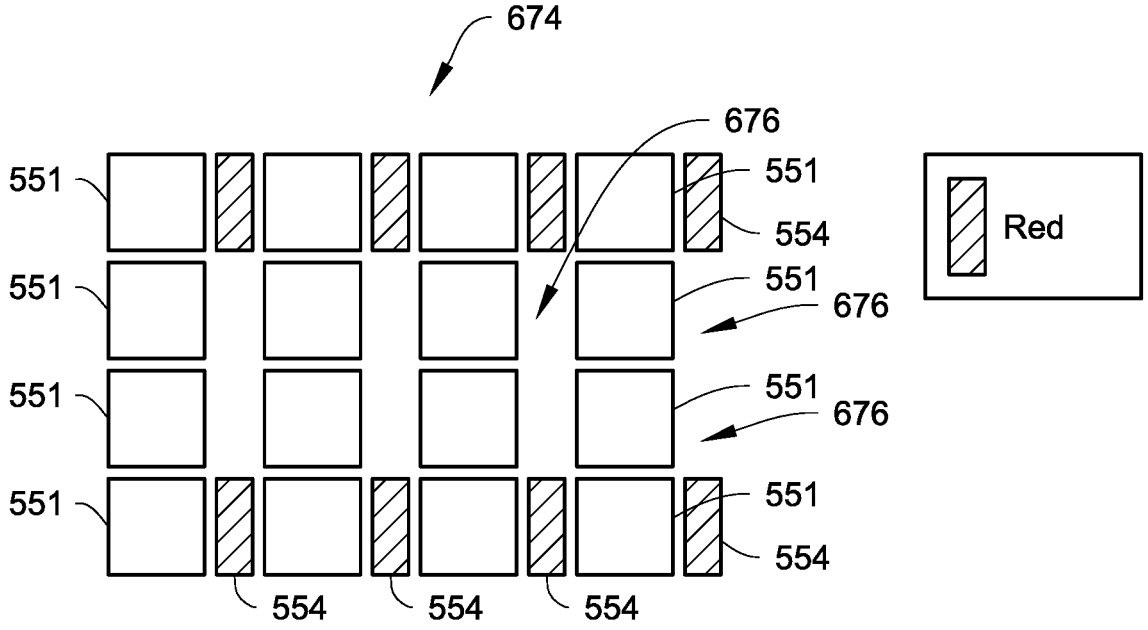
FIG. 6B illustrates a plan view of a pixel configuration of a display device, according to another embodiment.

FIGS. 6A and 6B illustrate a plan view of different pixel configurations 670, 674 of a display device (e.g., the display device 200 shown in FIG. 2A), according to two different embodiments. In the embodiments shown in FIGS. 6A and 6B, the pixel configurations 670, 674 each include a plurality of main pixels 551 arranged in a plurality of columns and rows to form a matrix. The pixel configurations 670, 674 also include a plurality of supplementary pixels 554. Each of the supplementary pixels 554 includes a color filter. In particular, the plurality of supplementary pixels 554 in the pixel configurations 670, 674 includes a red color filter. The red color filter allows the plurality of supplementary pixels 554 to illuminate a red color light. Although the supplementary pixels 554 illustrated in pixel configurations 670, 674 include a red color filter, in other embodiments, the supplementary pixels may include color filters that illuminate a different color such as blue, green, yellow, etc. In some embodiments, each of the plurality of supplementary pixels 554 can include a different color filter, as described above with respect to FIG. 5.

The pixel configurations 670, 674 form a ratio of main pixels 551 to supplementary pixels 554 that is more than one to one within the matrix. That is, the plurality of main pixels 551 and the plurality of supplementary pixels 554 form a ratio greater than 1:1, with the plurality of main pixels 551 outnumbering the plurality of supplementary pixels 554. The ratio of the plurality of main pixels 551 and the plurality of supplementary pixels 554 may be, for example, 2:1.

As shown in the pixel configuration 670 in FIG. 6A, a portion of main pixels of the plurality of main pixels 551 is adjacent in a column direction to a corresponding supplementary pixel of the plurality of supplementary pixels 554. In particular, a supplementary pixel of the plurality of supplementary pixels 554 is positioned to be to the right of each main pixel arranged in the left most column of main pixels 551 and the right most column of main pixels 551. It will be appreciated that in other embodiments, each of the supplementary pixels 554 can be positioned to the left of each main pixels arranged in the left most column of main pixels 551 and the left most column of main pixels 551. Also, it will be appreciated that in other embodiments, the plurality of supplementary pixels 554 can be positioned to be adjacent to other main pixels in other columns of the main pixels 551.

In the pixel configuration 674 in FIG. 6B, a portion of main pixels of the plurality of main pixels 551 is adjacent in a row direction to a corresponding supplementary pixel of the plurality of supplementary pixels 554. In particular, a supplementary pixel of the plurality of supplementary pixels 554 is positioned to be to the right of each main pixel arranged in the top most row of main pixels 551 and the bottom most row of main pixels 551. It will be appreciated that in other embodiments, each of the supplementary pixels 554 can be positioned to the left of each main pixel arranged in the top most row of main pixels 551 and the bottom most row of main pixels 551. Also, it will be appreciated that in other embodiments, the plurality of supplementary pixels 554 can be positioned to be adjacent to other main pixels in other rows of the main pixels 551.

As shown in FIG. 6B, the main pixels that form the middle two rows of the pixel configuration 674 are not positioned to the left of a supplementary pixel 554. Rather, the pixel configuration 674 includes a plurality of spaces 676 to the right of each of the main pixels 551 that form the middle two rows of the pixel configuration 674. Each of the plurality of spaces 676 can define an area between two adjacent gate lines and two adjacent source lines in which a pixel electrode and a TFT are not present. The two gate lines and two source lines are adjacent to each other to form a square or rectangular area.

Figure 7A:
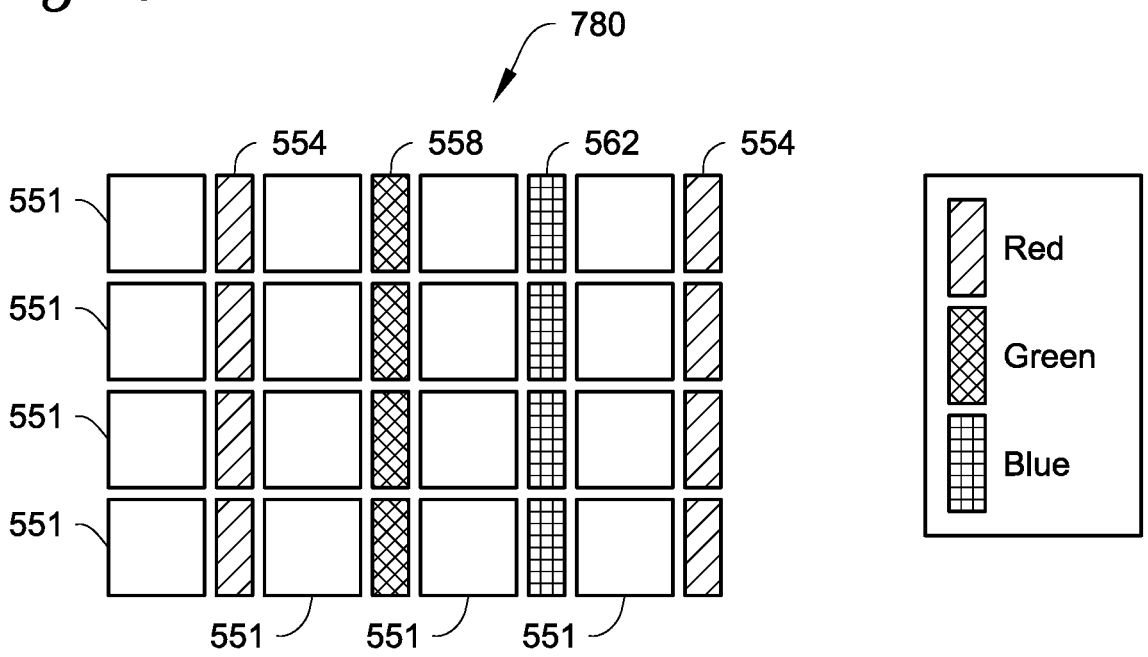
FIG. 7A illustrates a plan view of a pixel configuration of a display device, according to one embodiment.
Figure 7B:
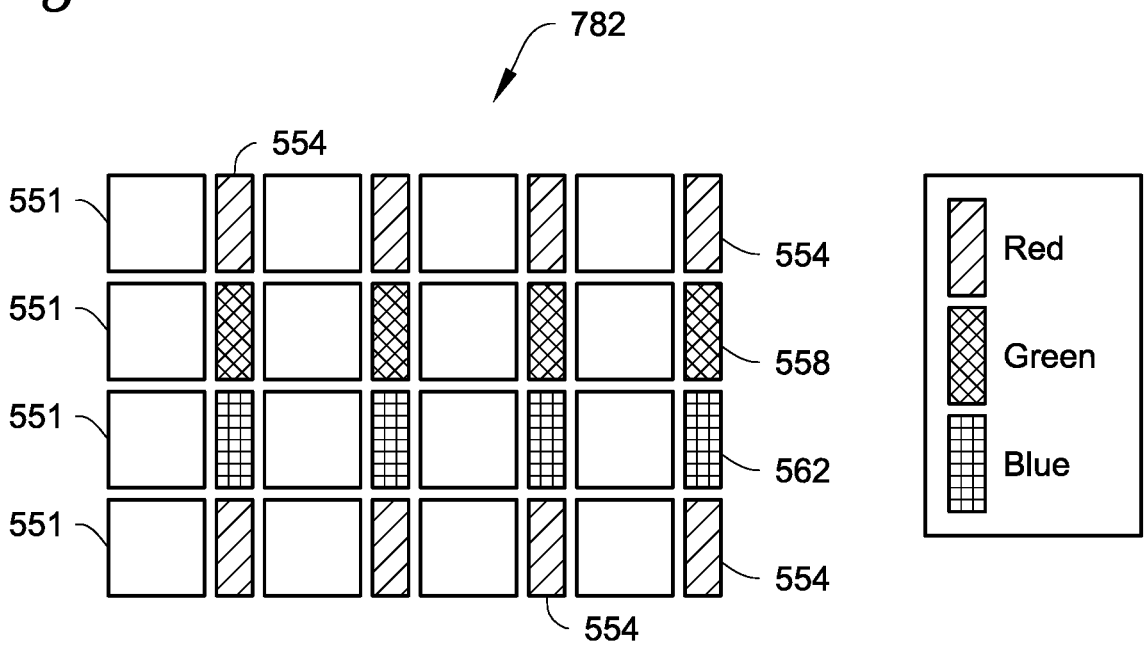
FIG. 7B illustrates a plan view of a pixel configuration of a display device, according to another embodiment.

FIGS. 7A and 7B illustrate plan views of pixel configurations 780, 782 of a display device (e.g., the display device 200 shown in FIG. 2A), according to two different embodiments. The pixel configurations 780, 782 include a plurality of main pixels 551 arranged in a plurality of columns and rows to form a matrix. The pixel configurations 780, 782 also include a plurality of supplementary pixels 554, 558, 562 each of which is positioned adjacent to a main pixel of the plurality of main pixels 551. The supplementary pixels 554, 558, 562 include different color filters to illuminate different colors of light. In particular, each of the supplementary pixels 554 include a red color filter to illuminate a red color light, each of the supplementary pixels 558 include a green color filter to illuminate a green color light, and each of the supplementary pixels 562 include a blue color filter to illuminate a blue color light.

As shown in the pixel configuration 780, each of the plurality of supplementary pixels 554, 558 and 562 are arranged in columns and positioned to the right of a column of the main pixels 551. For example, a first set of the plurality of supplementary pixels 554 are arranged in a column positioned to the right of the first column of main pixels 551, and a second set of the plurality of supplementary pixels 554 are arranged in a second column positioned to the right of the last column of main pixels 551. The plurality of supplementary pixels 558 are arranged in a column positioned to the right of the second column of main pixels 551 and the plurality of supplementary pixels 562 are arranged in a column positioned to the right of the third column of main pixels 551. Accordingly, columns of supplementary pixels 554, columns of supplementary pixels 558, and columns of supplementary pixels 562 can be alternately positioned within the matrix of the pixel configuration 780.

As shown in the pixel configuration 782, each of the plurality of supplementary pixels 554, 558 and 562 are arranged in rows and positioned to the right of each of the main pixels 551. For example, a first set of the plurality of supplementary pixels 554 are arranged in a top most row and a bottom most row of the matrix of the pixel configuration 782 with each of the supplementary pixels 554 positioned to the right of one of the main pixels 551 in the top most row and the bottom most row. The plurality of supplementary pixels 558 are arranged in a second row of the matrix of the pixel configuration 782 with each of the supplementary pixels 558 positioned to the right of one of the main pixels 551 positioned in the second row. The plurality of supplementary pixels 562 are arranged in a third row of the matrix of the pixel configuration 782 with each of the supplementary pixels 562 positioned to the right of one of the main pixels 551 positioned in the third row. Accordingly, rows of supplementary pixels 554, rows of supplementary pixels 558, and rows of supplementary pixels 562 can be alternately positioned within the matrix of the pixel configuration 782.

Figure 8:
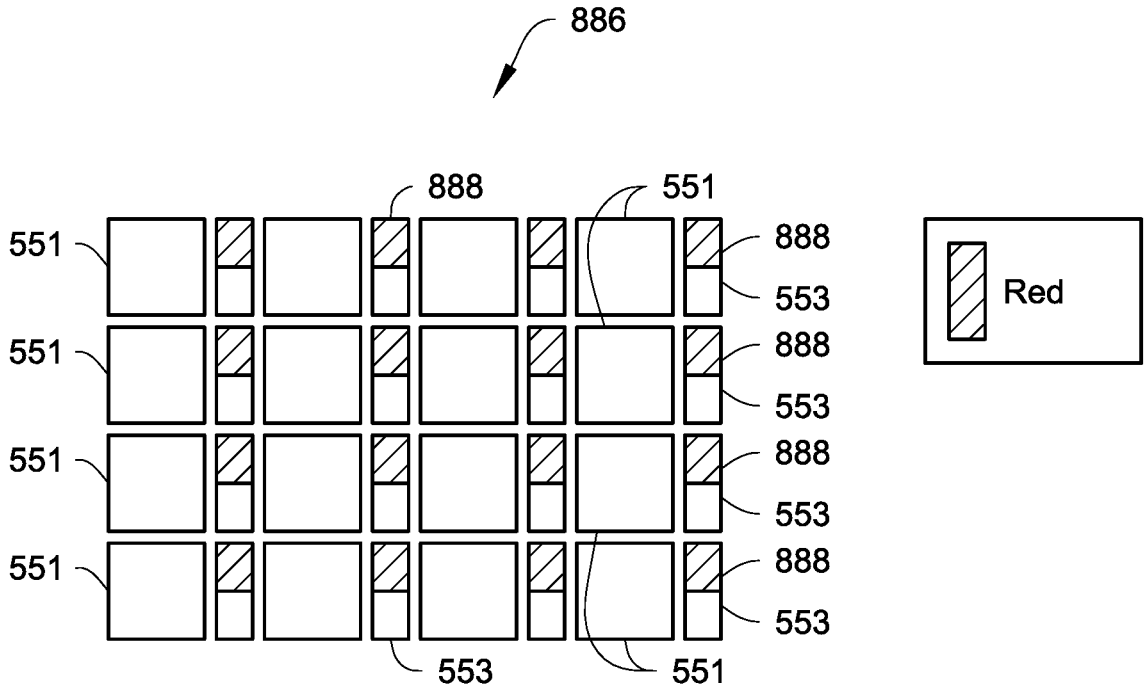
FIG. 8 illustrates a configuration of a plan view of a pixel configuration of a display device, according to one embodiment.

FIG. 8 illustrates a configuration of a plan view of a pixel configuration 886 of a display device (e.g., the display device 200 shown in FIG. 2A), according to one embodiment. The pixel configuration 886 includes a plurality of main pixels 551 and a plurality of supplementary pixels 553. Each of the supplementary pixels 553 includes a partial color filter 888. Each of the plurality of partial color filters 888 can be smaller in size a respective supplementary pixel electrode and/or supplementary pixel that the partial color filter 888 is associated with. That is, the color filter associated with each of the plurality of supplementary pixel electrodes of the supplementary pixels 553 may be half the size of the supplementary pixel electrode that the color filter is associated with. It will be appreciated that color filters can reduce the transmittance of light through the supplementary pixel electrodes of the supplementary pixels 553. Accordingly, the partial color filters 888 can suppress the reduction of transmittance of light illuminated by the plurality of supplementary pixel 553.

The plurality of partial color filters 888 are red color filters that allow the plurality of supplementary pixels 553 to illuminate a red color light. Although the supplementary pixels 553 illustrated in pixel configuration 886 represents include red color filter, it will be appreciated that in other embodiments the supplementary pixels 553 may include different color filters (e.g., blue, green, yellow, etc.) as described above with respect to FIG. 5, or a combination thereof.

Although the supplementary pixels 553 illustrated in pixel configuration 886 show that the plurality of main pixels 551 and the plurality of supplementary pixels 553 form a ratio of 1:1, different embodiments may have different ratios. For example, the ratio of the plurality of main pixels 551 and the plurality of supplementary pixels 553 may be a ratio of 2:1.

With regard to the foregoing description, it is to be understood that changes may be made in detail, without departing from the scope of the patent invention. It is intended that the specification and depicted embodiments are to be considered exemplary only, with a true scope and spirit of the invention being indicated by the broad meaning of the claims.

What is claimed is:

1. A display device, comprising:

a control circuit configured to receive image data and supplementary data; and a display panel that includes:

a source driver driving a plurality of source lines extending in a first direction;

a gate driver driving a plurality of gate lines extending in a second direction different from the first direction;

a plurality of thin film transistors (TFTs) each of which is connected to a corresponding gate line of the plurality of gate lines and connected to a corresponding source line of the plurality of source lines;

a plurality of main pixels, each of the plurality of main pixels including a main pixel electrode that is electrically connected to a corresponding TFT of the plurality of TFTs, and the plurality of main pixel electrodes are configured to display the image data; and a plurality of supplementary pixels, each of the plurality of supplementary pixels including a supplementary pixel electrode that is electrically connected to a corresponding TFT of the plurality of TFTs, the plurality of supplementary pixel electrodes are configured to display the supplementary data;

wherein the plurality of main pixel electrodes are arranged in a series of columns and rows to form a matrix, the plurality of supplementary pixel electrodes are interspersed within the matrix, wherein the plurality of main pixels are larger in size than the plurality of supplementary pixels, wherein each main pixel of the plurality of main pixels is defined by a main pixel area between two adjacent gate lines of the plurality of gate lines and two adjacent source lines of the plurality of source lines that surround the corresponding main pixel electrode of the respective main pixel, wherein each supplementary pixel of the plurality of supplementary pixels is defined by a supplementary pixel area between two adjacent gate lines of the plurality of gate lines and two adjacent source lines of the plurality of source lines that surround the corresponding supplementary pixel electrode of the respective supplementary pixel, and wherein the main pixel area is larger than the supplementary pixel area.

2. The display device of claim 1, wherein the control circuit provides the supplementary data, the image data, and timing signal data to the source driver, and the control circuit provides the timing signal data to the gate driver.

3. The display device of claim 1, wherein the plurality of main pixel electrodes are configured to display the image data as a monochrome image, and wherein each supplementary pixel electrode of the plurality of supplementary pixel electrodes is associated with a corresponding color filter to display the supplementary data in a secondary color.

4. The display device of claim 3, wherein the color filter associated with each of the plurality of supplementary pixel electrodes is a first color type color filter and the plurality of supplementary pixel electrodes are configured to display the supplementary data in a single secondary color based on the first color type color filter.

5. The display device of claim 3, wherein the color filter associated with each of a first set of the plurality of supplementary pixel electrodes is a first color type color filter to display a first color and the color filter associated with each of a second set of the plurality of supplementary pixel electrodes is a second color type color filter to display a second color that is different from the first color, and wherein the plurality of supplementary pixel electrodes and the associated color filters are configured to display the supplementary data in more than one secondary color such that the first set of the plurality of supplementary pixel electrodes display the supplementary data in the first color based on the first color type color filter and the second set of the plurality of supplementary pixel electrodes display the supplementary data in the second color.

6. The display device of claim 5, wherein the first set of the plurality of supplementary pixel electrodes are arranged in a first column within the matrix, and wherein the second set of the plurality of supplementary pixel electrodes are arranged in a second column within the matrix.

7. The display device of claim 5, wherein the first set of the plurality of supplementary pixel electrodes are arranged in a first row within the matrix, and wherein the second set of the plurality of supplementary pixel electrodes are arranged in a second row within the matrix.

8. The display device of claim 3, wherein the color filter associated with each of the plurality of supplementary pixel electrodes has a size smaller than the supplementary pixel electrode that the color filter is associated with.

9. The display device of claim 8, wherein the color filter associated with each of the plurality of supplementary pixel electrodes is less than half the size of the supplementary pixel electrode that the color filter is associated with.

10. The display device of claim 1, wherein each main pixel of the plurality of main pixels is adjacent in a row direction to a corresponding supplementary pixel of the plurality of supplementary pixels to form a ratio of main pixels to supplementary pixels that is one to one within the matrix.

11. The display device of claim 1, wherein a portion of the plurality of main pixels are adjacent to a corresponding supplementary pixel of the plurality of supplementary pixels in a single direction and a different portion of the main pixels of the plurality of main pixels are adjacent to other main pixels of the plurality of main pixels in the single direction such that the plurality of main pixels outnumber the plurality of supplementary pixels to form a ratio of main pixels to supplementary pixels that is greater than one to one within the matrix.

12. The display device of claim 1, wherein the plurality of main pixel electrodes is driven at a first refresh rate, the plurality of supplementary pixel electrodes is capable of being driven at a second refresh rate that is less than the first refresh rate.

13. The display device of claim 1, wherein the gate driver includes a first gate driver and a second gate driver, the plurality of gate lines include main pixel gate lines and supplementary gate lines, and the first gate driver drives the main pixel gate lines and the second gate driver drives the supplementary gate lines, wherein the plurality of TFTs include main TFTs and supplementary TFTs such that each of the main TFTs is electrically connected to a corresponding main pixel electrode of the plurality of main pixel electrodes and each of the supplementary TFTs is electrically connected to a corresponding supplementary pixel electrode of the plurality of supplementary pixel electrodes, wherein the plurality of source lines includes main pixel source lines and supplementary pixel source lines, wherein the main pixel source lines supply image voltages corresponding to the image data, and the supplementary pixel lines supply supplementary voltages corresponding to the supplementary data, and wherein the main pixel gate lines supply main gate voltages from the first gate driver to the main TFTs and the supplementary pixel gate lines supply the supplementary gate voltages from the second gate driver to the supplementary TFTs, and the first gate driver outputs the main gate voltages in line with a first refresh rate of the plurality of main pixel electrodes, and the second gate driver outputs the supplementary gate voltages in line with a second refresh rate of the plurality of supplementary pixel electrodes.

14. The display device of claim 13, wherein the second refresh rate is less than the first refresh rate.

15. The display device of claim 1, wherein the gate driver includes a first gate driver and a second gate driver, the plurality of gate lines include main pixel gate lines and supplementary gate lines, and the first gate driver drives the main pixel gate lines and the second gate driver drives the supplementary gate lines, wherein the source driver includes a first source driver and a second source driver, the plurality of source lines includes main pixel source lines and supplementary pixel source lines, and the first source driver drives the main pixel source lines and the second source driver drives the supplementary pixel source lines, wherein the plurality of TFTs include main TFTs and supplementary TFTs such that each of the main TFTs is electrically connected to a corresponding main pixel electrode of the plurality of main pixel electrodes and each of the supplementary TFTs is electrically connected to a corresponding supplementary pixel electrode of the plurality of supplementary pixel electrodes, wherein the main pixel source lines supply image data voltages corresponding to the image data from the first source driver to the main TFTs, and the supplementary pixel lines supply supplementary data voltages corresponding to the supplementary data from the second source driver to the supplementary TFTs, and wherein the main pixel gate lines supply the main gate voltages from the first gate driver to the main TFTs, and the supplementary pixel gate lines supply the supplementary gate voltages from the second gate driver to the supplementary TFTs, wherein the first gate driver outputs the main gate voltages in line with a first refresh rate of the plurality of main pixel electrodes, and the second gate driver outputs the supplementary gate voltages in line with a second refresh rate of the plurality of supplementary pixel electrodes.

16. The display device of claim 15, wherein the second refresh rate is less than the first refresh rate.

17. The display device of claim 1, further comprising a touch detection circuit configured to allow a user to input the supplementary data, wherein the touch detection circuit sends the supplementary data to the control circuit.

18. The display device of claim 1, wherein each of the plurality of main pixel electrodes is larger than each of the plurality of supplementary pixel electrodes.

19. The display device of claim 18, wherein each of the plurality of main pixel electrodes is in a range of approximately 2-5 times larger than each of the plurality of supplementary pixel electrodes.

20. A display device, comprising:

a control circuit configured to receive image data and supplementary data; and a display panel that includes:

a source driver driving a plurality of source lines extending in a first direction;

a gate driver driving a plurality of gate lines extending in a second direction different from the first direction;

a plurality of thin film transistors (TFTs) each of which is connected to a corresponding gate line of the plurality of gate lines and connected to a corresponding source line of the plurality of source lines;

a plurality of main pixels, each of the plurality of main pixels including a main pixel electrode that is electrically connected to a corresponding TFT of the plurality of TFTs, and the plurality of main pixel electrodes are configured to display the image data; and a plurality of supplementary pixels, each of the plurality of supplementary pixels including a supplementary pixel electrode that is electrically connected to a corresponding TFT of the plurality of TFTs, the plurality of supplementary pixel electrodes are configured to display the supplementary data;

wherein the plurality of main pixel electrodes are arranged in a series of columns and rows to form a matrix, the plurality of supplementary pixel electrodes are interspersed within the matrix, wherein the plurality of main pixels are larger in size than the plurality of supplementary pixels, wherein the gate driver includes a first gate driver and a second gate driver, the plurality of gate lines include main pixel gate lines and supplementary gate lines, and the first gate driver drives the main pixel gate lines and the second gate driver drives the supplementary gate lines, wherein the plurality of TFTs include main TFTs and supplementary TFTs such that each of the main TFTs is electrically connected to a corresponding main pixel electrode of the plurality of main pixel electrodes and each of the supplementary TFTs is electrically connected to a corresponding supplementary pixel electrode of the plurality of supplementary pixel electrodes, wherein the plurality of source lines includes main pixel source lines and supplementary pixel source lines, wherein the main pixel source lines supply image voltages corresponding to the image data, and the supplementary pixel lines supply supplementary voltages corresponding to the supplementary data, and wherein the main pixel gate lines supply main gate voltages from the first gate driver to the main TFTs and the supplementary pixel gate lines supply the supplementary gate voltages from the second gate driver to the supplementary TFTs, and the first gate driver outputs the main gate voltages in line with a first refresh rate of the plurality of main pixel electrodes, and the second gate driver outputs the supplementary gate voltages in line with a second refresh rate of the plurality of supplementary pixel electrodes.

* * * * *